US010900190B1

(12) United States Patent
Kim

(10) Patent No.: US 10,900,190 B1
(45) Date of Patent: Jan. 26, 2021

(54) HYDRAULIC JACK EXPANSION-TYPE ROTARY PENETRATION DEVICE FOR CIRCULAR PIPE

(71) Applicant: Kyu Sang Kim, Gyeonggi-do (KR)

(72) Inventor: Kyu Sang Kim, Gyeonggi-do (KR)

( * ) Notice: Subject to any disclaimer, the term of this patent is extended or adjusted under 35 U.S.C. 154(b) by 0 days.

(21) Appl. No.: 16/500,050

(22) PCT Filed: Apr. 5, 2018

(86) PCT No.: PCT/KR2018/004004
§ 371 (c)(1),
(2) Date: Oct. 1, 2019

(87) PCT Pub. No.: WO2018/186691
PCT Pub. Date: Oct. 11, 2018

(30) Foreign Application Priority Data

Apr. 7, 2017 (KR) ..... 10-2017-0045195

(51) Int. Cl.
*E02D 7/22* (2006.01)
*F16L 1/032* (2006.01)
*E02D 5/58* (2006.01)

(52) U.S. Cl.
CPC ..... *E02D 7/22* (2013.01); *E02D 5/58* (2013.01); *E02D 2300/002* (2013.01); *E02D 2600/20* (2013.01); *E02D 2600/40* (2013.01)

(58) Field of Classification Search
CPC .... E02D 5/58; E02D 7/22; E02D 7/28; E02D 11/00; E02D 2600/40; F16L 1/032
See application file for complete search history.

(56) References Cited

U.S. PATENT DOCUMENTS 3,314,241 A * 4/1967 Mayhall ..... E02D 7/00 405/228
3,808,821 A * 5/1974 Philo ..... E02D 5/385 405/241
4,239,419 A * 12/1980 Gillen, Jr. ..... E02D 5/523 405/232
RE32,267 E * 10/1986 Cherrington ..... E21B 7/046 175/386
4,637,758 A * 1/1987 Tamaki ..... E02D 7/20 405/232

(Continued)

FOREIGN PATENT DOCUMENTS

JP 2006037619 2/2006
JP 2008214890 9/2008

(Continued)

*Primary Examiner* — Benjamin F Fiorello
(74) *Attorney, Agent, or Firm* — IPLA P.A.; James E. Bame

(57) ABSTRACT

A hydraulic jack expansion-type rotary penetration device for a circular pipe comprises: a rotating head which receives torque from the outside; one or more hollow shafts arranged in series downward along the central axis of the rotating head; shaft-connection socket which interconnect the first hollow shaft which is connected to the rotating head with the remaining adjacent hollow shafts, to thereby transmit the torque of the rotating head; and one or more clamp modules which are installed in the hollow shafts and pressed against the inner surface of the circular pipe by hydraulic pressure generated in the rotating head to thereby generate clamping force.

5 Claims, 7 Drawing Sheets

(56) References Cited

U.S. PATENT DOCUMENTS

| | | | | | |
|---|---|---|---|---|---|
| 4,708,530 | A * | 11/1987 | Faber | B28B 21/42 | 405/252 |
| 4,911,581 | A * | 3/1990 | Mauch | E02D 5/56 | 173/11 |
| 5,516,237 | A * | 5/1996 | Hebant | E02D 7/28 | 405/133 |
| 6,142,712 | A * | 11/2000 | White | E02D 5/40 | 175/220 |
| 10,648,146 | B1 * | 5/2020 | Reulet | E02D 5/30 | |
| 2009/0214299 | A1 * | 8/2009 | Roussy | E02D 5/72 | 405/239 |
| 2010/0119309 | A1 * | 5/2010 | Gibberd | E02D 7/28 | 405/228 |
| 2012/0328374 | A1 * | 12/2012 | El Naggar | E02D 5/526 | 405/233 |
| 2014/0119835 | A1 * | 5/2014 | Heieie | E21B 10/28 | 405/184 |
| 2016/0348330 | A1 * | 12/2016 | GangaRao | E02D 7/14 | |

FOREIGN PATENT DOCUMENTS

| | | |
|---|---|---|
| KR | 100841735 | 6/2008 |
| KR | 1020100094215 | 8/2010 |
| KR | 1020130011776 | 1/2013 |

* cited by examiner

HYDRAULIC JACK EXPANSION-TYPE ROTARY PENETRATION DEVICE FOR CIRCULAR PIPE

BACKGROUND

The present disclosure relates to a hydraulic jack expansion-type rotary penetration device for a circular pipe, the device being capable of smoothly rotating and inserting a circular pipe, which is made of concrete or plastic vulnerable to torsional shear failure during rotation, into the ground while maintaining a clamping force evenly generated over the entirety of the inner wall of the pipe.

In general, steel pipes used for pile construction in building or civil engineering are durable against torsional stress, but when the circular pipes made of concrete or plastic material (PHC piles or plastic sewer pipes, etc.) are rotated into the ground, they are vulnerable to torsional failure due to the low tensile strength thereof.

Therefore, when vertical pipes such as piles and vertical shafts are inserted vertically into the ground, when a pipe is drilled horizontally with respect to the ground surface by a trenchless technology, when a circular pipe such as sewage pipe is inserted into the ground, or when a circular pipe is inserted into the ground at an angle, there is a problem that a circular pipe made of concrete or plastic material cannot be applied.

In other words, when the concrete or plastic circular pipe is rotated and inserted into the ground by applying torque at the rear end of the circular pipe, a large torque is required due to the skin friction developed between ground and the inner and outer wall of the circular pipe, and if a large torque is applied on the pipe, torsional failure occurs in the circular pipe made of concrete or plastic materials whose tensile strength is much weaker than compressive strength. For this reason, it was difficult to construct the concrete circular pipe vulnerable to torsional stress by rotary penetration method.

As a related art, a Korea Patent Registration No. 10-0994374, 'Apparatus for driving pile by rotation and method thereof' has been proposed. This apparatus includes a cylindrical casing inserted into the inside of a pile and coupled to a pile driver above the pile and an excavating member rotated and pressed into the ground. In connecting the casing to the excavation member, a connection member has an insertion part fixed to the lower end of the casing and a fixing part fixed to the upper end of the excavating member. Since the insertion part of the casing is temporarily fixed at the connection member, after the casing is rotated and then the excavating member is inserted to a selected depth, the casing is pulled out, whereby only the excavating member, the pile, and the connection member are buried in the ground, and thus it is easy to embed the pile.

However, in the former related art, since the excavation is, performed by the excavating member during the excavation, there is, a gap between the pile (or casing) and the drilling hole, which requires additional grouting work. In addition, the background art of the former is a method of rotating the excavation member connected to the tip of the pile, whereas the present invention is a method of rotating the pile itself, which is different from the former.

Another related art is 'Noiseless and no vibration-free ready-made screw pile penetrating method by rotating and pushing', Korea Patent Registration No. 10-0841735. This technology, which relates to driving screw concrete piles into the ground, is difficult to apply to current PHC piles not having a helix on the outer surface thereof. Moreover, this related art is difficult to apply to a sewer pipes made of plastic. In addition, when the pile is to rotate the rear end of the screw concrete pile, the pile is vulnerable to torsional shear failure.

SUMMARY OF THE INVENTION

The present disclosure provides the hydraulic jack expansion-type rotary penetration device for circular pipe in order to rotate and insert a circular pipe made of concrete or plastic into the ground while maintaining a clamping force evenly generated on the entire inner wall of the circular pipe.

The hydraulic jack expansion-type rotary penetration device for circular pipe is characterized by including a rotating head which receives an external torque; one or more hollow shafts arranged in series downward along the central axis of the rotating head; a shaft connection socket which interconnects the first hollow shaft, which is connected to the rotating head, with the remaining adjacent hollow shafts, to thereby transfer the torque of the rotating head; a clamping module which is installed in the hollow shafts and pressed against the inner wall of the circular pipe by hydraulic pressure generated in the rotating head to thereby generate a clamping force.

In addition, the rotating head includes a head connecting hollow shaft with a polygonal insert; a head housing mounted above the head connecting hollow shaft; a battery mounted in the inside of the head housing; a hydraulic pump electrically connected to and operated by the battery; a solenoid valve connected to an outlet of the hydraulic pump thereby to regulate hydraulic flow; a controller electrically connected to the hydraulic pump and the solenoid valves with a communication unit (206A) to remotely control from the outside.

In addition, the shaft connection socket includes a polygonal bore penetrated with polygonal cross section and a screw hole arrayed in 2 layers along perimeter of the shaft connection socket. The hollow shaft comprises a polygonal connection connected to equivalent cross section of the polygonal bore in the shaft connection socket.

In addition, the clamp module includes a pair of clamp chucks arranged to face each other and a pair of hydraulic jacks connected to opposite ends of a pair of clamp chucks via pivot pins to move the pair of the clamp chucks in a radial direction. The clamp chuck includes a ring plate having the same radius of curvature as the inner surface of the circular pipe, a pair of hydraulic jack connecting plates joined to inner surface of the ring plate by being spaced symmetrically up and down thereby to support the hydraulic jack with a hinge, a rotation locking plate provided to form a keyway in the center between the pair of hydraulic jack connecting plates, and a friction pad joined to the outer peripheral surface of the ring plate.

The clamp module includes a pair of clamp chucks arranged to face each other, a pair of hydraulic jacks connected to one end of the pair of clamp chucks by a pivot pin to move the pair of the clamp chucks in a radial direction, a hinge plate hinged to the other end of the pair of clamp chuck via a pivot pin and fixed to the hollow shaft. The clamp chuck includes a ring plate having the same radius of curvature as the inner surface of the circular pipe, a pair of hydraulic jack connecting plates joined to inner surface of the ring plate by being spaced symmetrically up and down thereby to support the hydraulic jack with a hinge and a friction pad joined to the outer peripheral surface of the ring plate.

According to the present disclosure of the hydraulic jack expansion-type rotary penetration device for circular pipe, a clamping force is evenly generated over the entirety of the inner wall of the circular pipe when rotated and inserted into the ground. Thus, a stress concentration in any specific part of the circular pipe which can cause a failure is prevented. As a result, a circular pipe made of concrete or plastic, which is vulnerable to torsional shear failure, can be smoothly rotated and inserted into the ground without damage or failure.

In addition, if the hydraulic jack expansion-type rotary penetration device is applied to the concrete screw pile, not only noise and vibration are prevented but also the problem of skin friction reduction due to the relaxation of the ground as, a result of drilling a borehole whose diameter larger than that of a pile, before the pile is inserted, can be improved and the construction period is shortened. Moreover, if the threaded concrete screw pile is used, the pile can penetrate the ground with a lower compressive force applied.

In addition, since there is no need to drill a borehole before inserting a circular pipe, it is not required to inject cement mortar in order to stabilize the borehole at the time of pre-drilling, thereby reducing the material cost.

BRIEF DESCRIPTION OF THE DRAWINGS

While the present disclosure has been described in connection with what is presently considered to be practical exemplary embodiments, it is to be understood that the invention is not limited to the disclosed embodiments.

DETAILED DESCRIPTION OF THE INVENTION

While the present disclosure has been described in connection with what is presently considered to be practical exemplary embodiments shown in the accompanying drawings, it is to be understood that the present disclosure is not limited to thereto.

Figure 1:
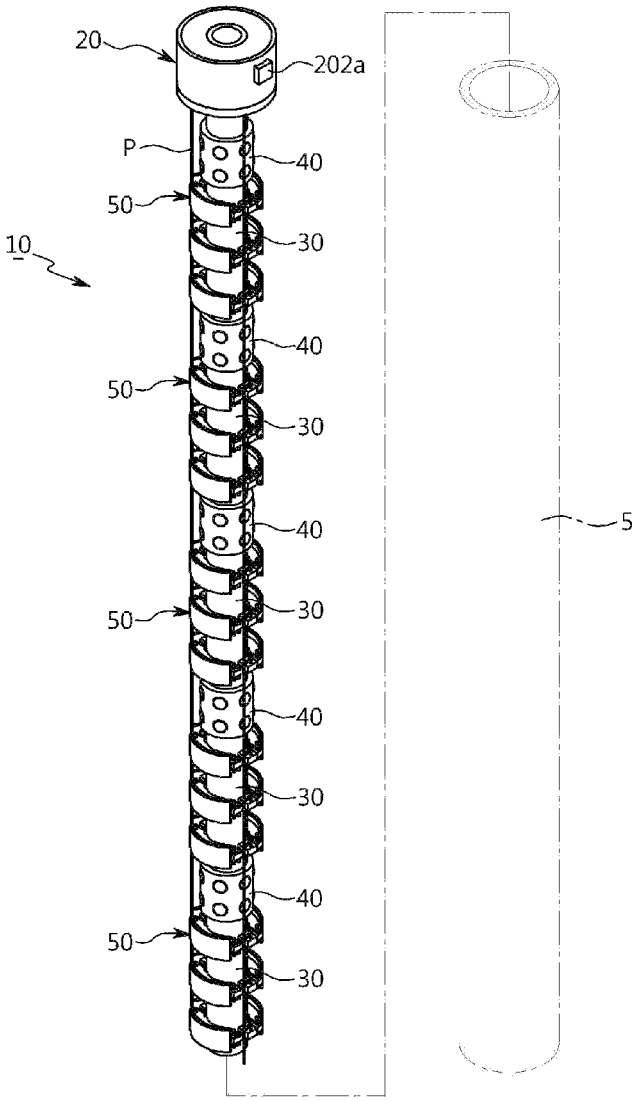
FIG. 1 is a perspective view of the hydraulic jack expansion-type rotary penetration device for circular pipe.
Figure 2:
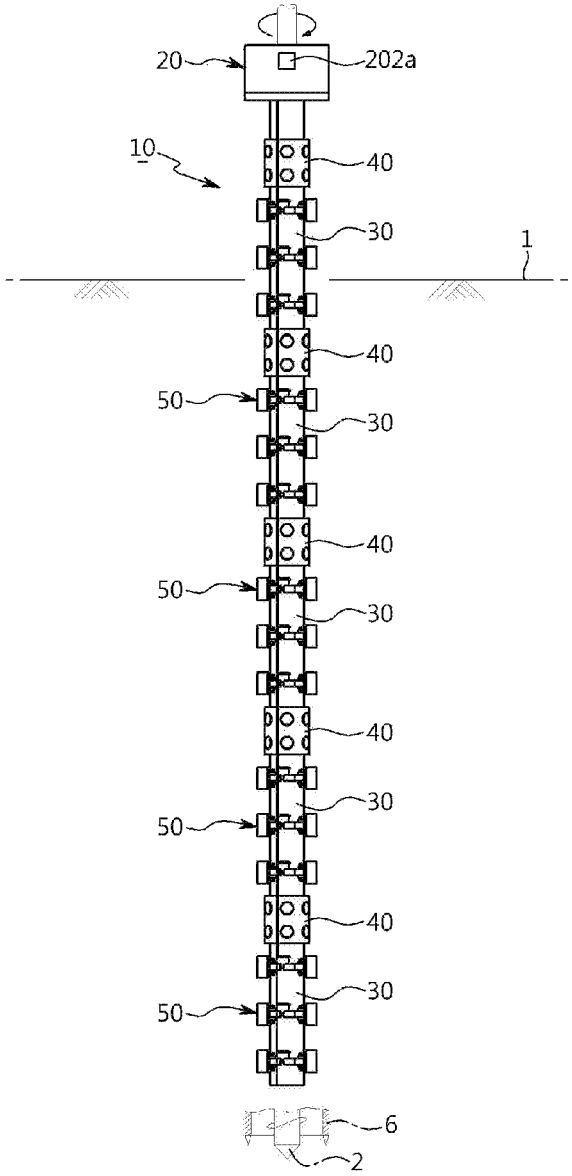
FIG. 2 is a side view showing the installing status of rotating and inserting circular pipe using the hydraulic jack expansion-type rotary penetration device for circular pipe of FIG. 1.

As illustrated in FIGS. 1 and 2, the hydraulic jack expansion-type rotary penetration device for circular pipe can be used for rotating and inserting the circular pipe into the ground. The example of the circular pipe (5) can be a PHC pile installed vertically or a sewer pipe installed horizontally. The sewer pipe can be made of metal or synthetic resin.

As illustrated in FIGS. 1 to 5, the hydraulic jack expansion-type rotary penetration device for circular pipe (10), is characterized by including a rotating head (20) which receives an external torque, a hollow shaft (30) arranged in series downward along the central axis of the rotating head (20), a shaft connection socket (40) which interconnects the first hollow shaft (30), which is joined to the rotating head (20), with the remaining adjacent hollow shaft (30 and 30) to thereby transfer the torque of the rotating head (20), and a clamping module (50) which is installed in the hollow shafts (30) and pressed against the inner wall of the circular pipe (5) by hydraulic pressure generated in the rotating head (20) to thereby generate clamping force.

The rotating head (20), for example, can be connected to the pile driver to thereby receive torque. The number of the hollow shafts (30) and clamping modules (5) can increase or decrease, depending on the length of the circular pipe (50). The hollow shaft (30) is equipped with a key (30A) to rotate the clamp module (50).

Figure 3:
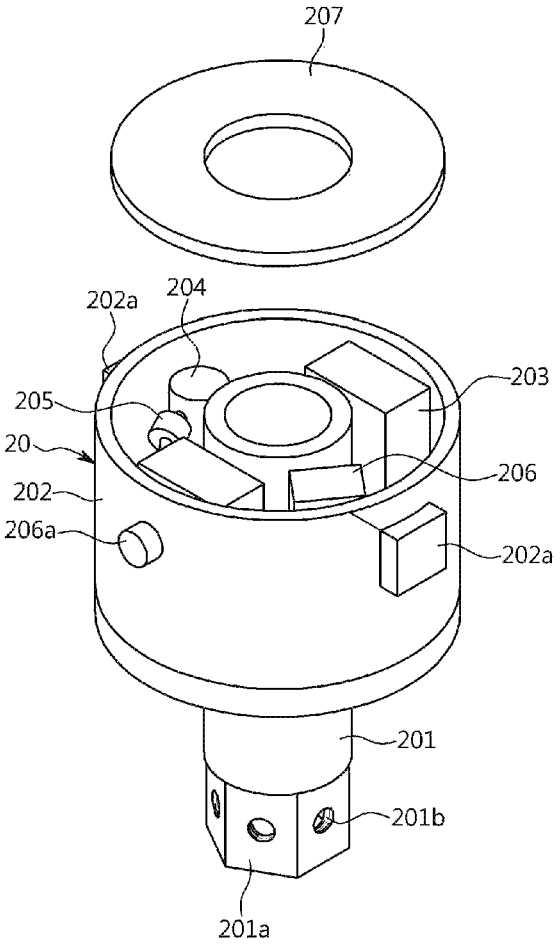
FIG. 3 is a perspective view showing the inside of the upper rotating head of the hydraulic jack expansion-type rotary penetration device for circular pipe illustrated in FIG. 1.
Figure 4:
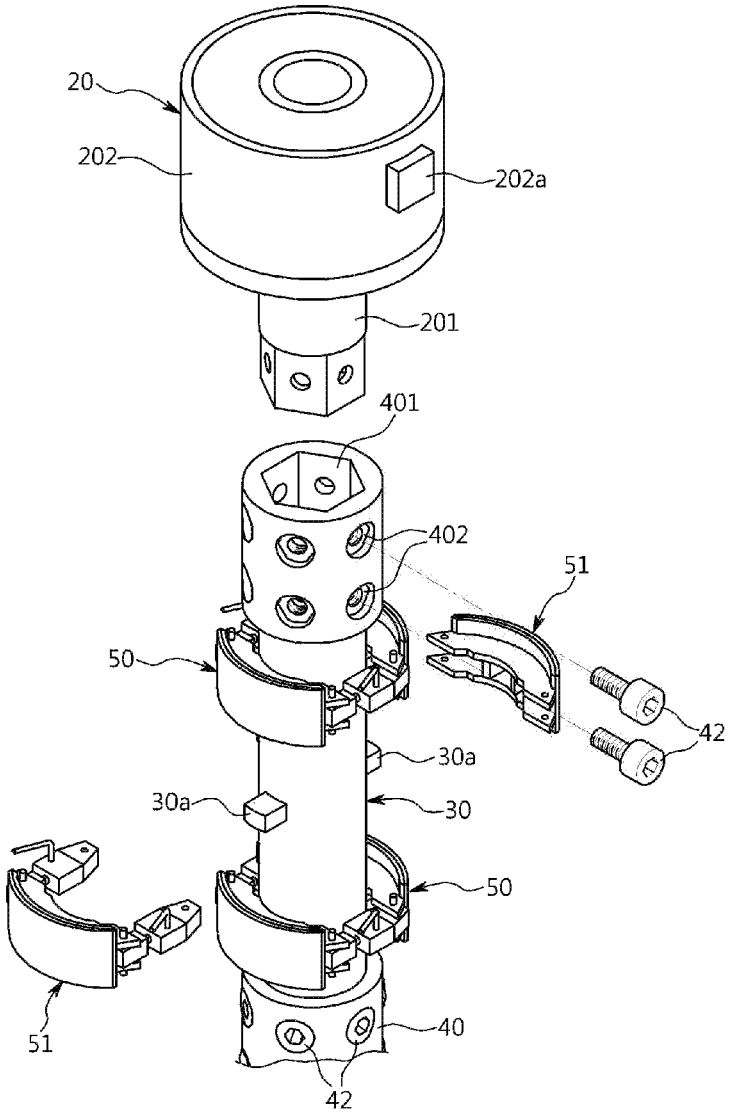
FIG. 4 is a perspective view of the rotating head shown in FIG. 3 being separated from the hollow shaft of the hydraulic jack expansion-type rotary penetration device for circular pipe.
Figure 5:
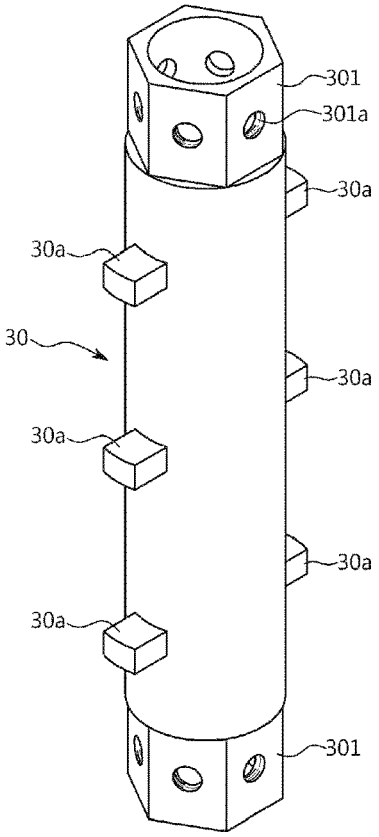
FIG. 5 is a perspective view of the hollow shaft as an exemplary embodiment of the present disclosure.

As illustrated in FIG. 3, the rotating head (20) includes a head connecting hollow shaft (201) with a polygonal insert (201A) where a screw hole is formed, a head housing (202) mounted above the head connecting hollow shaft (201) and having a rotary key (202A) on the outer peripheral surface, a battery (203) mounted in the inside of the head housing (202), hydraulic pump (204) electrically connected to and operated by the battery (203), a solenoid valve (205) connected to an outlet of the hydraulic pump (204) and regulating hydraulic flow and a controller (206) electrically connected to the hydraulic pump (204) and the solenoid valves (205) with a communication unit (206A) to remotely control f 0 the outside.

The solenoid valve (25) is switched in response to the electrical signal of the controller (206) and regulates the hydraulic flow, depending on the switching position. As a result, a remote controller which is not shown, can operate the hydraulic pump (204) or switch the direction of the solenoid valve by communicating with the controller (206).

Figure 6:
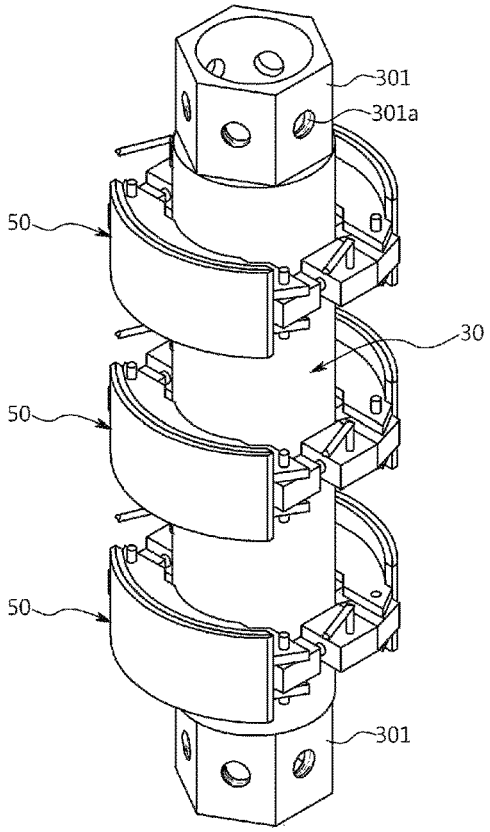
FIG. 6 is a perspective view of coupling between the hollow shaft and the clamp module as an exemplary embodiment of the present disclosure.
Figure 7:
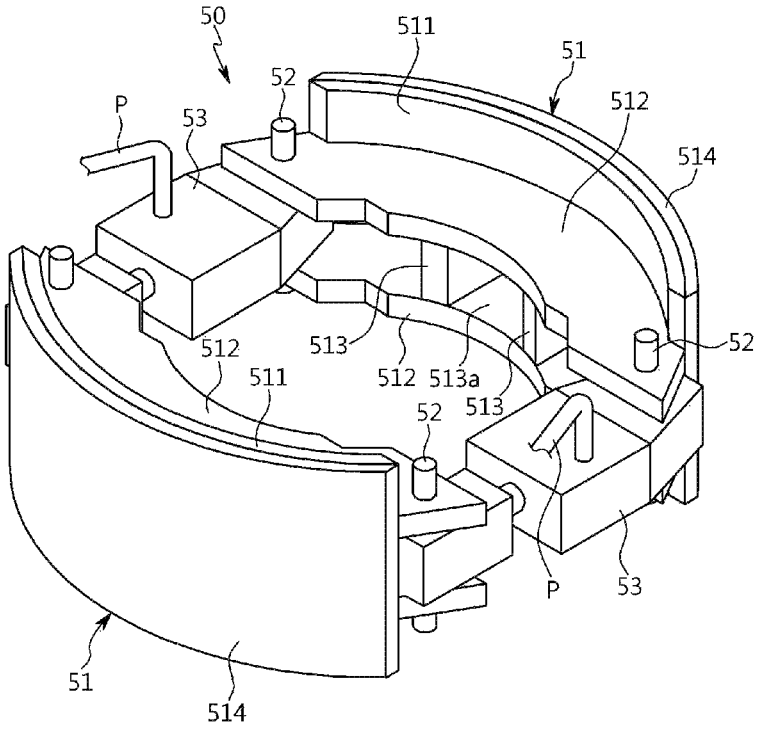
FIG. 7 is a perspective view of one form of a clamping module as an exemplary embodiment of the present disclosure.

The shaft connection socket (40) includes a polygonal bore (401) penetrated with a polygonal cross section and a screw hole (402) circularly arrayed in 2 layers. The hollow haft (30) includes a polygonal connection (301) connected to the equivalent cross section of the polygonal bore (401) of the shaft connection socket (40). Accordingly, bolts inserted at the screw holes (402) and then assembled with nuts are used for connecting two parts of the hollow shafts (30 and 30) after the polygonal connection (301) is inserted into a polygonal bore (401) inside the connection socket (40). At this time, the hollow shafts (30 and 30) can transfer torque by the connection of the polygonal section between the hollow shafts (30 and 30). As illustrated in FIG. 6 and FIG. 7, the clamping modules (50) are arranged in the longitudinal direction at a predetermined interval along one or more hollow shafts (30). The clamping force evenly distributed on the inner wall of a circular pipe in the longitudinal direction can rotate and insert the circular pipe since the clamping modules (50) in the hydraulic-jack expansion-type rotary penetration device is evenly arranged on the hollow shaft (30). Accordingly, the concentrated torsional stress causing a failure of a specific part of the circular pipe (5) which is rotated and inserted into the ground is prevented. The clamp module (50) includes a pair of clamp chucks (51, 51) arranged to face each other, a pair of hydraulic jacks (53) connected to opposite ends of a pair of clamp chucks (51, 51), by pivot pins (52) to move the pair of the clamp chucks (51, 51) in the radial direction. At this time, each hydraulic jack (53) is connected to the hydraulic pump (204) via a hydraulic hose (P).

The hydraulic coupling can be used for connecting hydraulic hoses (p) between clamp modules (50), and an on-off valve not shown can be connected with hydraulic coupling for the closure and opening of the hydraulic flow.

Figure 9:
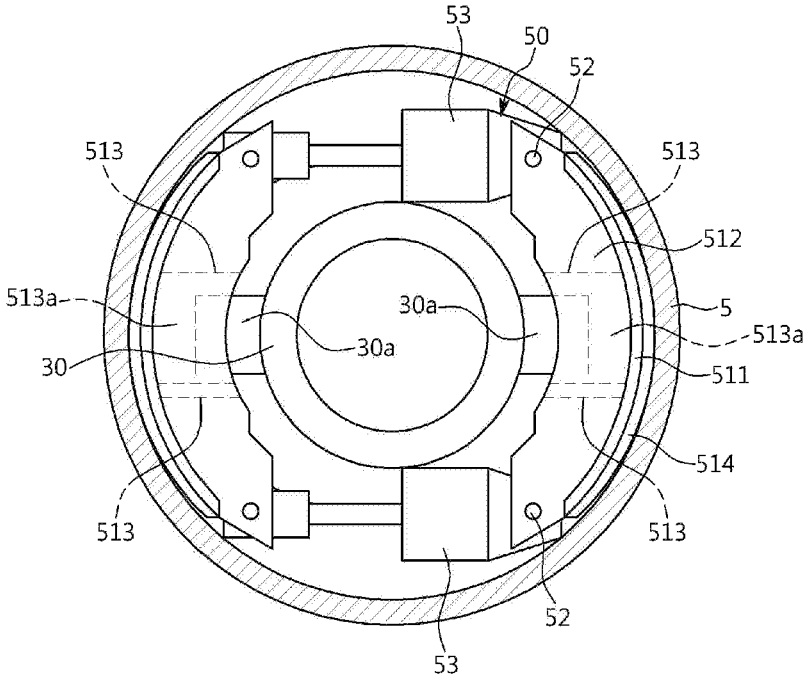
FIG. 9 is an operating condition of the clamping module of FIG. 7, clamping a circular pipe.

As illustrated in FIG. 7 and FIG. 9, the clamp chuck (51) includes a ring plate (511) having the same radius of curvature as the inner surface of the circular pipe (5), a pair of hydraulic jack connecting plates (512, 512) joined to inner surface of the ring plate (511) by being spaced symmetrically up and down thereby to hinge-support the hydraulic jack (53), a rotation locking plate (513) provided to form a keyway (513A) in the center between the pair of hydraulic jack connecting plates (512, 512) and a friction pad (514) joined to the outer peripheral surface of the ring plate (511).

The friction pad (514) can be made of rubber to protect the inside wall of the circular pipe and at the same time increase a friction force. The key (30A) of the hollow shaft (30) is coupled to the keyway (513A) of the clamp chuck. Therefore, the torque of hollow shaft (30) can be transmitted to the clamp chuck (51) via the coupling between the key (30A) and the keyway (513A). Although the clamp modules (50) are arranged in 3 layers in the embodiment drawings, the number of the clamp modules (50) can be modified, depending on the length of the hollow shaft (30).

The unexplained sign, '207', is 'a head housing cover plate.'

The following description will explain how a circular pipe can be installed in the field, using the hydraulic jack expansion-type rotary penetration device for circular pipe (10) which is organized as described in the previous statement. First, the hydraulic jack expansion-type rotary penetration device for circular pipe (10) is inserted into the inside of the circular pipe.

Next, by operating the hydraulic pump (204) in the rotating head (2) and pushing the hydraulic jack (53), as illustrated in the FIG. 9, the clump chuck (51) is expanded in the radial direction. Thereby, the friction pad in the clump chuck (51) contacts and finally presses the inner wall of the circular pipe (5) uniformly.

Thereafter, when the circular pipe is inserted into the ground (1) while the hydraulic jack expansion-type rotary penetration device for circular pipe (10) is rotated, a friction force is generated between the friction pad (514) and the inner wall of the circular pipe (5), and the circular pipe (5) and the hydraulic jack expansion-type rotary penetration device for circular pipe (10) are integrated and rotated under the ground At this time, since the hydraulic jack expansion-type rotary penetration device for circular pipe (10) is rotated while being pressed to the inner wall of the circular pipe (5), the torsional stress is evenly distributed along the longitudinal direction of the circular pipe (5).

Therefore, it is possible to prevent the torsional stress from being concentrated, compared with the conventional method of rotating the rear end of the circular pipe (5).

On the other hand, in case of the circular pipe (5) penetrating hard ground, as illustrated in FIG. 2, a casing shoe (6) is attached at the tip of the circular pipe (5), and an auger drill (2) is inserted into the inside of the hollow shaft of the hydraulic jack expansion-type rotary penetration device (10).

The auger drill (2) (or earth drill) excavates the ground (1) prior to the circular pipe (5) proceeding, thereby forming free faces. When the circular pipe (5) is rotated and inserted, the casing shoe (6) advances, crushing the ground. The soil outside of the casing shoe (6) is pushed outward, increasing the density of the ground around the circular pipe (5) and hardening the soil, and the soil inside the casing shoe (6) pushed to the inward direction, after being crushed by the auger drill (2), is carried along the rotating screw of the auger drill (2) to the longitudinal direction, and finally discharged from the circular pipe (5).

Therefore, if the hydraulic jack expansion-type rotary penetration device for circular pipe (10) is used, the clamping force developed on the inner wall of the circular pipe (5) is maintained, and the circular pipe made of concrete or plastic, which is vulnerable to torsional shear failure, can be smoothly rotated and inserted into the ground. In addition, since the excavated soil is finally discharged through the inner wall of the hollow shaft (5) and no gap between the outer wall of the circular pipe and the excavated the hole is created, additional grouting work is not required.

In addition, if the hydraulic jack expansion-type rotary penetration device is applied to a concrete screw pile, not only noise and vibration are prevented but also the problem of skin friction reduction due to the relaxation of the ground as a result of pre-drilling a borehole whose diameter larger than that of a pile, before the pile is inserted, can be improved and the construction period is shortened. Moreover, since there is no need to pre-drill a hole in the ground, it is not required to inject cement mortar into a borehole to stabilize the borehole wall during pre-boring process, thereby saving material cost.

The hydraulic jack expansion-type rotary penetration device for circular pipe (10) can be also applied to the pre-boring method. In this case, when a hole smaller than the diameter of a pile is drilled and the pile with the conical shoe at the tip is rotated and driven to the pre-bored hole using the hydraulic jack expansion-type rotary penetration device for circular pipe (10), the skin friction can be effectively increased because the circular pile can be rotated and inserted while expanding the diameter of the pre-drilled hole.

Figure 8:
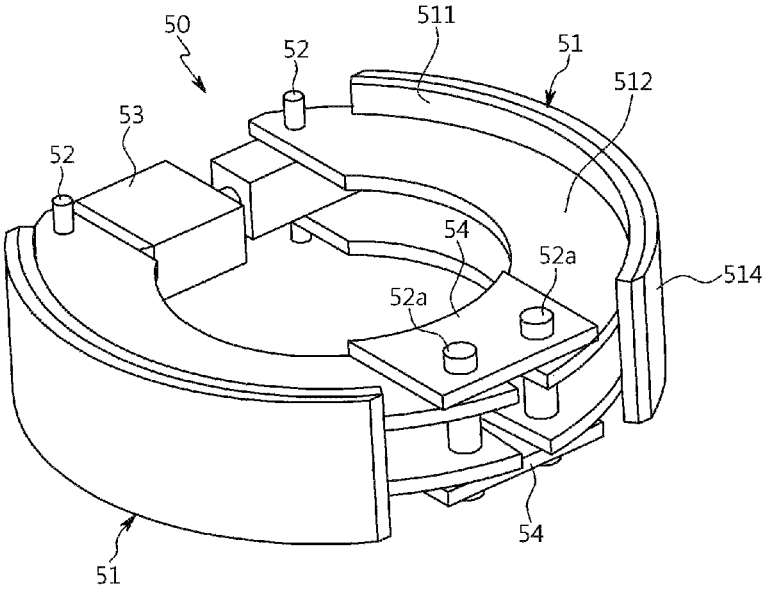
FIG. 8 is a perspective view of another form of a clamp module as an exemplary embodiment of the present disclosure.
Figure 10:
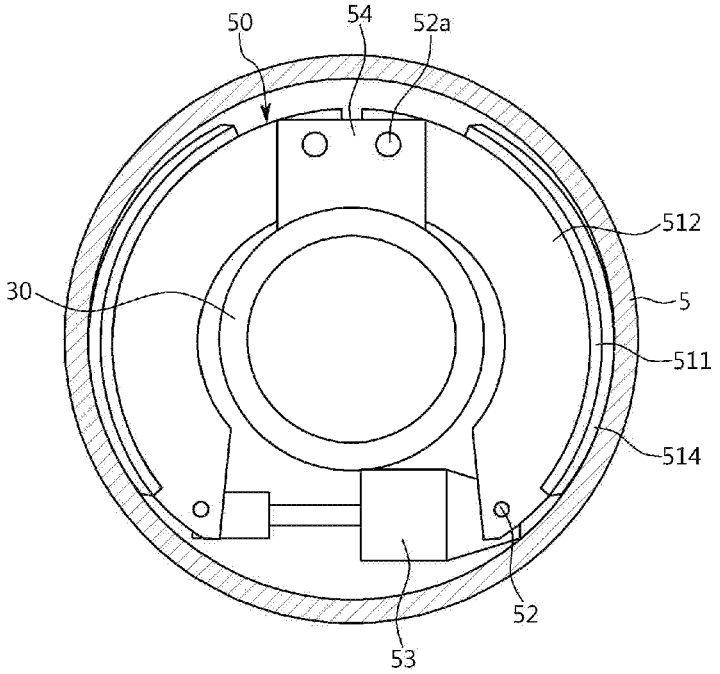
FIG. 10 is an operating condition of the clamping module of FIG. 8, clamping a circular pipe.

Meanwhile, another modified example of the clamp, module (5), as shown in FIGS. 8 and 10, can include a pair of clamp chucks (51, 51) arranged to face each other, a hydraulic jack (53) connected to one end of the pair of clamp chucks (51, 51) by a pivot pin (52) to move the pair of the clamp chucks (51, 51) in the radial direction and a hinge plate (54) connected to the other end of the pair of clamp chuck (51, 51) via a pivot pin (52A).

As illustrated in FIG. 10, a hinge plate (54) is fixed to the hollow shaft (30). Therefore, the hollow shaft (3) and the hinge plate (54) can be rotated together. In this case, the rotation locking plate (513) in FIG. 7 can be omitted.

Therefore, when the hydraulic jack (53) is operated, a pair of clamp chucks (51, 51) revolves on the axis of the pivot pin of the hinge plate (54). Then the friction pad (514) is pressed against the inside wall of the circular pipe (5), and the clamping effect works. The circular pipe (5) can be rotated and inserted by the same installation method described above.

While this invention has been described in connection with what is presently considered to be practical exemplary embodiments, it is to be understood that the invention is not limited to the disclosed embodiments, but on the contrary, is intended to cover various modifications and equivalent arrangements included within the spirit and scope of the appended claims. It should be understood that various changes, substitutions, and alterations can be made herein without departing from the spirit and scope of the disclosure as defined by the following claims.

INDUSTRIAL APPLICABILITY

The hydraulic jack expansion-type rotary penetration device for circular pipe described in the present disclosure enables smooth rotating and inserting of a circular pipe, which is made of plastic or concrete vulnerable to torsional shear failure during rotation, into the ground while maintaining a clamping force evenly generated over the entirety of the inner wall of the circular pipe.

In addition, if the hydraulic jack expansion-type rotary penetration device for circular pipe is applied to a steel pipe, the invention described in the present disclosure can rotate and insert a relatively thin steel pipe into the ground while torsional and buckling failure of the steel pipe are prevented.

What is claimed is:

1. A hydraulic jack expansion-type rotary penetration device for circular pipe for rotating and inserting a circular pipe (5), the device comprising:

a rotating head (20) which receives external torque;

a hollow shaft (30) arranged in series downward along the central axis of the rotating head (20);

a shaft connection socket (40) which interconnects the first hollow shaft (30) which is connected to the rotating head (20) with the remaining adjacent hollow shafts (30 and 30), to thereby transfer the torque of the rotating head (20); and a clamping module (50) which is installed in the hollow shaft (30) and pressed against the inner wall of the circular pipe (5) by hydraulic pressure generated in the rotating head (20) to thereby generate clamping force.

2. The hydraulic jack expansion-type rotary penetration device for circular pipe of claim 1, wherein the rotating head (20) comprises:

a head connecting hollow shaft (201) having a polygonal insert (201A);

a head housing (202) mounted above the head connecting hollow shaft (201);

a battery (203) mounted inside the head housing (202);

a hydraulic pump (204) electrically connected to and operated by the battery (203);

a solenoid valve (205) connected to an outlet of the hydraulic pump (204) and regulating hydraulic flow; and a controller (206) electrically connected to the hydraulic pump (204) and the solenoid valves (205) with a communication unit (206A) to remotely control from the outside.

3. The hydraulic jack expansion-type rotary penetration device for circular pipe of claim 1, wherein the shaft connection socket (40) comprises:

a polygonal bore (401) penetrated inside with polygonal cross section and having a screw hole (402) circularly arranged in 2 layers, and the hollow shaft (30) comprises a polygonal connection (301) connected to the equivalent cross section of the polygonal bore (401) in the shaft connection socket (40).

4. The hydraulic jack expansion-type rotary penetration device for circular pipe (5) of claim 1, wherein the clamp module (50) comprises:

a pair of clamp chucks (51, 51) arranged to face each other; and a pair of hydraulic jacks (53) connected to opposite ends of a pair of clamp chucks (51, 51) by a pivot pin (52) to move the pair of the clamp chucks (51, 51) in the radial direction, wherein the clamp chuck (51) comprises:

a ring plate (511) having the same radius of curvature as the inner surface of the circular pipe (5);

a pair of hydraulic jack connecting plates (512, 512) joined to inner surface of the ring plate (511) by being spaced symmetrically up and down thereby to hinge-support the hydraulic jack (53);

a rotation locking plate (513) provided to form a keyway (513A) in the center between the pair of hydraulic jack connecting plates (512, 512); and a friction pad (514) bonded to the outer peripheral surface of the ring plate (511).

5. The hydraulic jack expansion-type rotary penetration device for circular pipe (5) of claim 1, wherein the clamp module (50) comprises:

a pair of clamp chucks (51, 51) arranged to face each other;

a hydraulic jack (53) connected to one end of the pair of clamp chucks (51, 51) by a pivot pin (52) to move the pair of the clamp chucks (51, 51) in a radial direction; and a hinge plate (54) hinge-connected to the other end of the pair of clamp chuck (51, 51) via a pivot pin (52A) and fixed to the hollow shaft (30), wherein the clamp chuck (51) comprises:

a ring plate (511) having the same radius of curvature as the inner surface of the circular pipe (5);

a pair of hydraulic jack connecting plates (512, 512) joined to the inner surface of the ring plate (511) by being spaced symmetrically up and down thereby to hinge-support the hydraulic jack (53); and a friction pad (514) bonded to the outer peripheral surface of the ring plate (511).

* * * * *